United States Patent [19]

Sheu

[11] Patent Number: 4,775,200

[45] Date of Patent: Oct. 4, 1988

[54] FURNITURE WITH LEG PROTECTION DEVICE

[76] Inventor: Hal C. Sheu, No. 23-2, Lane 667, Chung Shan Rd., Shen Nan Tsun, Shern Kang Hsiang, Taichung Hsien, Taiwan

[21] Appl. No.: 137,107

[22] Filed: Dec. 23, 1987

[51] Int. Cl.[4] ..... A47B 81/06

[52] U.S. Cl. ..... 312/229; 312/7.2

[58] Field of Search ..... 312/228, 229, 7.2

[56] References Cited

U.S. PATENT DOCUMENTS 41,986 3/1864 Fobes ..... 312/228

531,956 1/1896 Miller et al. ..... 312/228 X 3,063,766 11/1962 Goettl ..... 312/228

*Primary Examiner*—Joseph Falk

*Attorney, Agent, or Firm*—Antonelli, Terry & Wands

[57] ABSTRACT

The invention provides a leg protection device for furniture to prevent insects from entering the furniture. The device includes liquid receptacles which have central sleeves for receiving furniture legs. A liquid such as water can be put into a chamber of each receptacle around each sleeve. Conduit means are provided to intercommunicate the receptacles for conveniently discharging used water or filling fresh water. The liquid receptacles are enclosed below a bottom wall of the furniture so as to avoid contamination of the liquid in the receptacles.

7 Claims, 4 Drawing Sheets

FURNITURE WITH LEG PROTECTION DEVICE

BACKGROUND OF THE INVENTION

This invention relates to a piece of furniture and particularly to a piece of furniture having legs which are associated with liquid receptcales which surround the legs with liquid to prevent the intrusion of insects into the furniture.

Insects such as ants prefer to enter and hide or protect themselves in furniture such as cabinets and cupboards which store food, clothes, books, etc., or climb onto tables, such as dining tables and the like to hunt for food. Usually, they enter in or climb up these articles by way of the legs. Conventionally, people put pan-like vessels to support the legs of furniture and place a liquid such as water or the like in the vessels so that ants are prevented from reaching the legs. However, the conventionally used vessels have disadvantages in that the vessels affect adversely the appearance of the furniture and the liquid in the vessels easily becomes dirty since the vessels are open so that dust is permitted to enter easily therein. In addition, it is difficult to clean the vessels or remove dirty water from the bowls and it is easy for mosquitoes to generate in the dirty bowls. Moreover, the legs immersed in water for a long time may be worn easily.

SUMMARY OF THE INVENTION

An object of the present invention is to provide a piece of furniture with a leg protection device which prevents insects from entering the furniture through its legs.

According to the present invention, a furniture body which has its bottom end with legs connected thereto is provided with liquid receptacles which are respectively attached to the legs. Each liquid receptacle has an open top end, a bottom wall, a surrounding wall connected to the bottom wall and having a liquid outlet opening, and a leg sleeve member integrally connected to the bottom wall within the surrounding wall. The sleeve member is spaced from the surrounding wall to confine with the surrounding wall a liquid chamber and has a through-hole therein for receiving in snug fit each of the legs, the through-hole being sealed off from the liquid chamber.

In one aspect of the invention, conduit means is provided to intercommunicate the liquid receptacles, enabling one to easily add liquid to all receptacles. The conduit means has a liquid discharge outlet means for removing used liquid from the receptacle and an overflow outlet means for permitting excess liquid to flow out of the receptacles when the receptacles are being filled.

In another aspect of the invention, a furniture comprises: a furniture body having a top wall, a bottom wall, legs connected to the said bottom wall, a vertical rear wall connected to a rear side of the bottom wall and a rear side of the top wall, two opposite vertical side walls connected to the rear wall, the top and bottom walls, the rear wall and the side walls having bottom portions extending to a level which is lower than the bottom wall so as to surround the legs but is higher than bottom ends of the legs so that they are spaced from the floor, the furniture body further having a front panel which is connected to said bottom wall and said bottom portions of said side walls and which has a bottom end higher than bottom ends of said legs. Liquid receptacles are respectively attached to the legs of the furniture. The furniture so arranged provides an enclosed space below the bottom wall thereof for covering liquid receptacles, thereby avoiding contamination of the liquid.

The present exemplary preferred embodiment will be described in detail with reference to the following drawings, in which:

DETAILED DESCRIPTION OF THE PREFERRED EMBODIMENT

Figure 1:
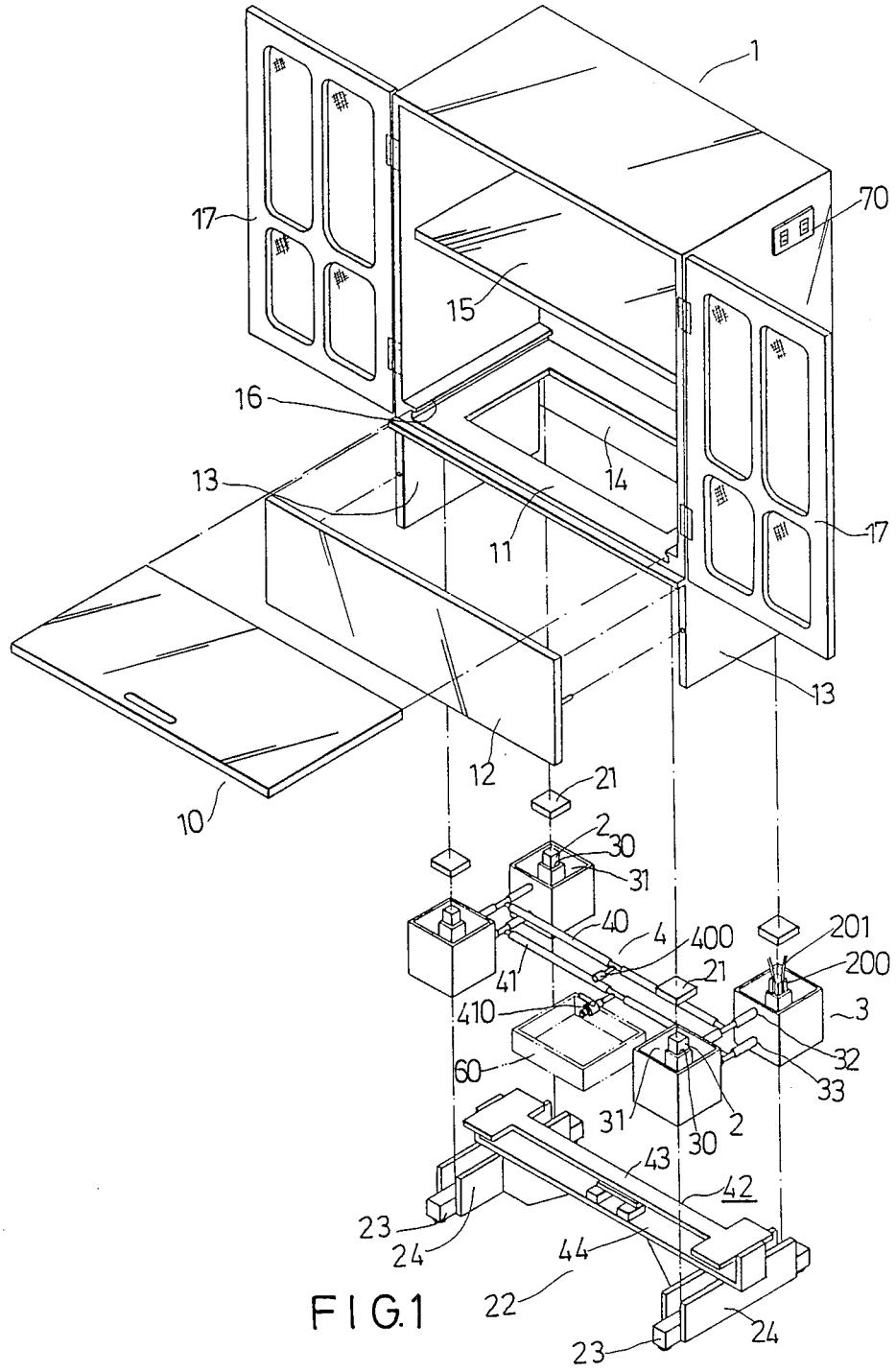
FIG. 1 is an exploded view showing a cabinet incorporating a preferred embodiment of the present invention.
Figure 2:
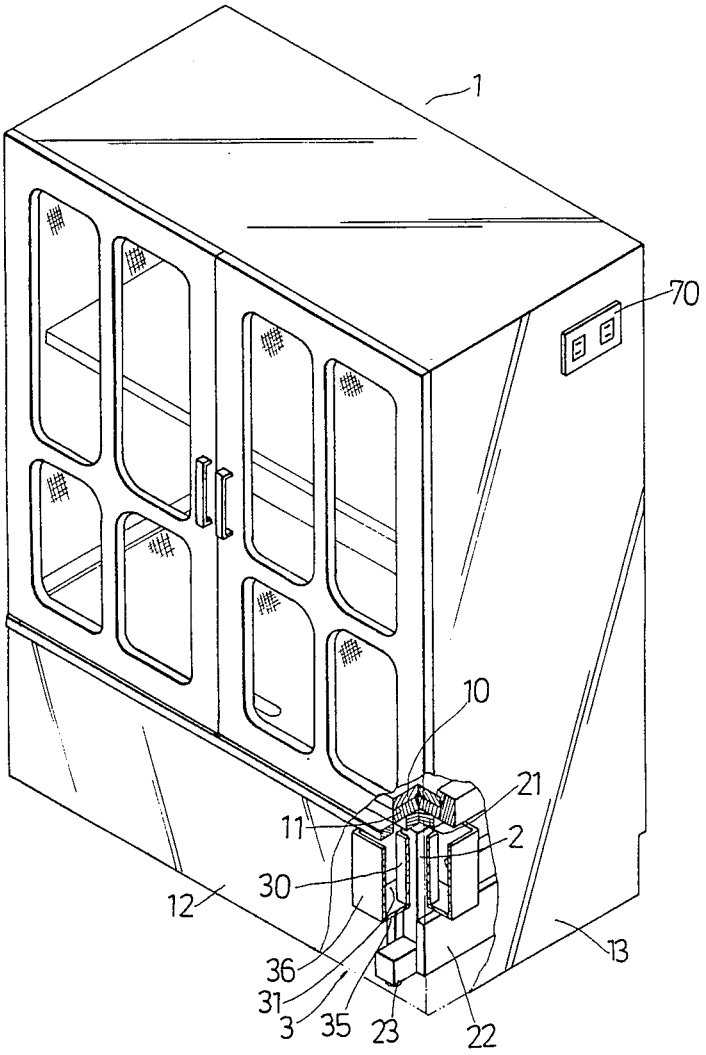
FIG. 2 is a perspective view of the cabinet of FIG. 1.

Referring to the drawings, a preferred embodiment of the present invention is shown, including a cabinet 1, four legs 2, liquid receptacles 3, and conduit means 4.

The cabinet 1 includes a rear wall 14, two side walls 13, a shelf 15 between its top wall and bottom wall, and two front doors 17. The bottom wall of the cabinet 1 designated at 11 is a fixed rectangular framework which supports a removable panel 10. The removable panel 10 can be drawn in or out of the cabinet by placing its edges in two guide channels 16 provided on the bottom wall 11. The legs 2 are fixed to the bottom wall 11 through packing plates 21 which in turn is bonded adhesively to the wall 11. The lower ends of the rear and side walls extend to a level lower than the bottom wall 10 so as to house the legs 2. A front panel 12 is secured to the side walls 13 so as to cooperate with the bottom portions of the side and rear walls to enclose the legs 2. While the bottom portions of the side walls and rear wall, and the front panel 12 enclose the legs 2, their bottom ends are still spaced from the floor.

The liquid receptacles 3 are molded plastic bodies each of which has a bottom wall 35 and a surrounding wall 36 with a rectangular cross-section opening at its top, and a leg sleeve 30 integrally formed on the bottom wall 35. The wall of the leg sleeve is spaced from the surrounding wall 36 to confine therewith a surrounding liquid chamber 31 for receiving a liquid such as water or the like. Openings 32 and 33 are provided in the surrounding wall 36 for draining the liquid. Each sleeve 30 is opened at the top and bottom thereof and the interior of the sleeve 30 is sealed off from the liquid chamber 31. The receptacles 3 are attached to the legs 2 by sleeving respectively the sleeve members 30 on the legs 2 in snug fit in such a manner that the top ends of the surrounding wall 36 is spaced apart from the bottom wall 11.

The legs 2 extend through the sleeve members 30 and are then connected to a bottom reinforcement frame 22. The frame 22 has two parallel leg supports 23 which are secured to the legs 2. Brace members 24 are connected to two sides of the leg supports 23 and an upper trasverse bar assembly 42 which includes a transverse bar 44 secured to the brace members 24 and an upper transverse bar 43 having an I-shape. By means of the reinforcement frame 22, the weight of the cabinet can be transferred to the floor uniformly, thereby increasing the stability of the cabinet. It can be noted that all the receptacles 30 are enclosed below the bottom wall 11 by the bottom portions of the rear and side walls and the front panel 12. This avoids contamination of the receptacles and the liquid contained therein.

The conduit means 4 includes an upper conduit assembly 40 which has manifolds to be connected to the upper openings 32 of the receptacles 3 and a lower conduit assembly 41 which has manifolds to be connected to the lower openings 33 of the receptacles 3. The upper conduit assembly 40 has a liquid outlet means 400 and the lower conduit assembly 41 has a liquid discharge valve 410. The upper and lower conduit assemblies 40 and 41 are respectively secured to or tied to two bars 43 and 44.

Figure 3:
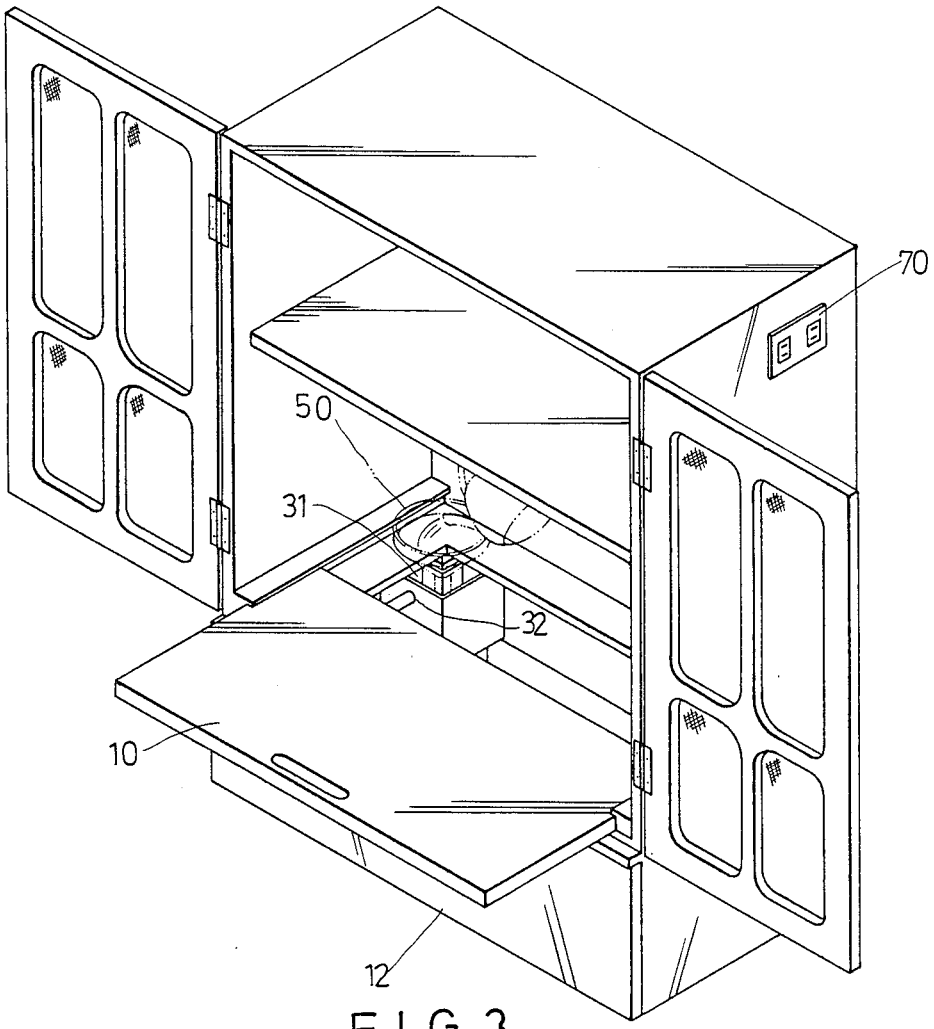
FIG. 3 shows how to put water into the receptacles of the present invention.
Figure 4:
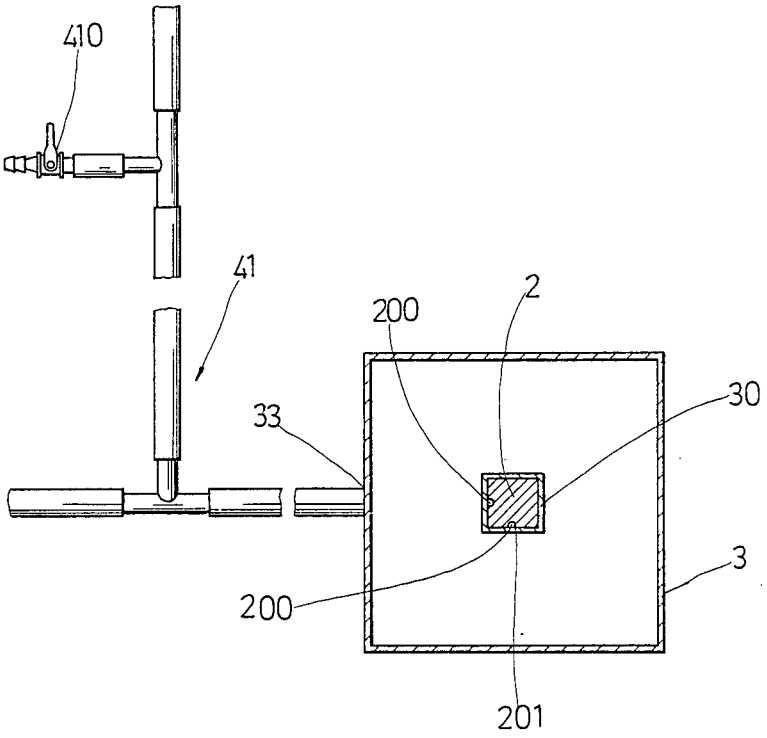
FIG. 4 is a fragmentary plan view showing one of the receptacles and a portion of the conduit means connected to the receptacle.

Referring to FIG. 3, when water is to be placed in the receptacles 3, the removable bottom panel 10 must be first drawn out of the cabinet. Then, water is poured in one of the receptacle 3 by using a funnel 50. Once the water is put into one of the receptacle 3, water will flow to all other receptacles 3 through the conduit means 4 and excess water will flow out through the outlet means 400 of the conduit assembly 40 to a tray 60.

If ants climb up to the wall of the receptcales 30 through the bottom reinforcement frame 22, they will be prevented from reaching the legs 2 because water surrounds the legs 2. Since the surrounding wall of the receptacles 30 is spaced from the bottom wall 11 of the cabinet, the ants are also kept out of reach of the bottom wall from the receptacles 30.

The present invention has a further feature in that the receptacles 30 are not exposed. This improves the appearance of the cabinet and minimizes the risk of dirtying the receptacles and the water contained therein.

When the water in the receptacles 3 is to be removed for supplying fresh water, the removable bottom panel 10 is drawn out and the discharge valve 410 of the conduit assembly 41 is operated to discharge used water to the tray 60.

According to the present invention, the legs 2 may be further provided with peripheral grooves 200. When the legs 2 are inserted through the sleeve members 30, the grooves 200 form passages through which conductors 201 connect electrically an electrical device 70 mounted in the cabinet to an electric source. This arrangement can also prevent ants from entering the cabinet through the conductors.

With the invention thus explained, it is apparent that various modifications and variations can be made without departing from the scope of the invention. It is therefore intended that the invention be limited only as indicated in the appended claims.

What is claimed is:

1. A cabinet comprising:

a cabinet body having a top wall, a bottom wall, legs connected to a bottom side of said bottom wall, a vertical rear wall connected to a read side of said bottom wall and a rear side of said top wall, two opposite vertical side walls connected to said rear wall and said top and bottom walls, said rear wall and said side walls having bottom portions extending to a level which is lower than said bottom wall so as to surround said legs but is higher than bottom ends of said legs so that said bottom portions are spaced apart from the floor, said cabinet body further having a front panel which is connected to said bottom wall and said bottom portions of said side walls and which has a bottom end higher than bottom ends of said legs, liquid receptacles attached respectively to said legs, each of said liquid receptacles having an open top end, a bottom wall, a surrounding wall connected to said bottom wall of said receptacle and having a liquid outlet opening means, and a leg sleeve member integrally connected to said bottom wall of said receptacle within said surrounding wall, said sleeve member being spaced from said surrounding wall to confine with said surrounding wall a liquid chamber and having a through-hole therein for receiving in snug fit each of said legs, said through-hole being sealed off from said liquid chamber; and conduit means intercommunicating said liquid receptacles at said liquid outlet opening means and having a liquid discharge means.

2. A cabinet as claimed in claim 1, wherein said liquid outlet opening means of each of said receptacles has an upper opening and a lower opening in said surrounding wall, said conduit means including an upper conduit assembly connected to said upper openings of said receptacles and having an overflow outlet means, and a lower conduit assembly connected to said lower openings of said receptacales and having said liquid discharge means.

3. A cabinet as claimed in claim 2, wherein said bottom wall of said cabinet body includes a fixed bottom wall which has an opening accessible to a space below said bottom wall of said cabinet, a removable bottom panel disposed on said fixed bottom wall and having two edges parallel to said side walls, and channel means disposed on said bottom wall for receiving slideably said edges of said removable bottom panel.

4. A cabinet as claimed in claim 3, further comprising a front door means hinged to said side walls.

5. A cabinet as claimed in claim 4, further comprising a leg reinforcing bottom frame associated with said legs, said leg reinforcing bottom frame including reinforcing horizontal bars each of which is connected to bottom ends of a pair of said legs, and a transverse horizontal bar interconnecting said reinforcing horizontal bars, wherein said conduit means is secured to said transverse horizontal bar.

6. A cabinet as claimed in claim 1, wherein said legs are provided with lateral grooves which extend along the length of the legs, said lateral grooves forming passages for threading conductors therethrough when said leg sleeve members are sleeved around said legs.

7. A furniture comprising a furniture body having a horizontal bottom wall and legs connected to said bottom wall;

vertical wall means associated with said bottom wall to confine an enclosed space below said bottom wall to enclose said legs;

liquid receptacles attached respectively to said legs, each of said liquid receptacles having an open top end, a bottom wall, a surrounding wall connected to said bottom wall of said receptacle and having a liquid outlet opening means, and a leg sleeve member integrally connected to said bottom wall of said receptacle within said surrounding wall, said sleeve member being spaced from said surrounding wall to confine with said surrounding wall a liquid chamber and having a through-hole therein for receiving in snug fit each of said legs, said through-hole being sealed off from said liquid chamber; and conduit means intercommunicating said liquid receptacles at said liquid outlet opening means and having a liquid discharge means.

* * * * *